US012480730B2

(12) United States Patent
Forbes et al.

(10) Patent No.: US 12,480,730 B2
(45) Date of Patent: Nov. 25, 2025

(54) FIREARM SHOOTING REST

(71) Applicants: Dave Forbes, Kirksville, MO (US); Carman Forbes, Kirksville, MO (US); Ron Bean, Cedar Rapids, IA (US)

(72) Inventors: Dave Forbes, Kirksville, MO (US); Carman Forbes, Kirksville, MO (US); Ron Bean, Cedar Rapids, IA (US)

( * ) Notice: Subject to any disclaimer, the term of this patent is extended or adjusted under 35 U.S.C. 154(b) by 0 days.

(21) Appl. No.: 18/917,343

(22) Filed: Oct. 16, 2024

(65) Prior Publication Data

US 2025/0123071 A1 Apr. 17, 2025

Related U.S. Application Data

(60) Provisional application No. 63/590,591, filed on Oct. 16, 2023.

(51) Int. Cl.
*F41A 23/10* (2006.01)

(52) U.S. Cl.
CPC ..... *F41A 23/10* (2013.01)

(58) Field of Classification Search
CPC ..... F41A 23/00; F41A 23/02; F41A 23/08; F41A 23/10; F41A 23/12; F41A 23/14; F41A 23/16; F41A 23/56
USPC ..... 42/94
See application file for complete search history.

(56) References Cited

U.S. PATENT DOCUMENTS

| | | | | |
|---|---|---|---|---|
| 5,964,435 | A | 10/1999 | Peltier | |
| 5,979,099 | A | 11/1999 | Kervin | |
| 7,188,445 | B2 | 3/2007 | Lehman | |
| 9,976,693 | B1 * | 5/2018 | Delikat | F16B 9/054 |
| 2008/0202326 | A1 * | 8/2008 | Carroll | F41A 23/12 89/37.01 |
| 2012/0227305 | A1 * | 9/2012 | Fontenot | F41A 23/02 42/94 |
| 2014/0352193 | A1 | 12/2014 | Bull | |
| 2016/0374329 | A1 * | 12/2016 | Garrett | A01M 31/02 182/115 |
| 2017/0191783 | A1 * | 7/2017 | Gutierrez | F16M 13/022 |
| 2020/0056857 | A1 | 2/2020 | Stubbs | |

* cited by examiner

*Primary Examiner* — Bret Hayes
(74) *Attorney, Agent, or Firm* — Nyemaster Goode, P.C.

(57) ABSTRACT

A firearm rest configured to attach to a mounting surface, such as the generally horizontal window sill of a hunting blind. The firearm rest includes a support member, support posts, and an attachment assembly. The support member provides a generally horizontal surface for a hunter to rest the forearm of a firearm. The support posts are configured to selectively adjust the height of the support member relative to the attachment assembly. The support posts are pivotably combined with the attachment assembly thereby allowing the support member to be movable between an extended position and a retracted position while the attachment assembly remains secured to the mounting surface. The retracted position is sometimes desirable to allow the hunter better access to the window or the window sill.

20 Claims, 5 Drawing Sheets

FIREARM SHOOTING REST

BACKGROUND

The present invention generally relates to firearm accessories, and more particularly to a firearm shooting rest that is useful in supporting a portion of a firearm on a wall or near the window of a hunting blind or stand.

In the art of hunting, short reaction time, stealth, and accuracy are favorable attributes for the hunter. Because of the typically long periods that a hunter must wait for prey to enter the field of view, it is fatiguing and thus impractical to hold a firearm at a ready position for the entire time. Consequently, hunters typically place their firearms in some more comfortable position while waiting. When the prey enters the field of view, the hunter repositions the firearm. The repositioning of a firearm takes time, creates noise, and makes accurate shooting less likely. Therefore, it is advantageous for the hunter to have the firearm generally resting to overlook the field of view into which the weapon will be fired.

A common hunting location is inside a game blind where the hunter is partly protected from the elements and is partly hidden from game. In such situations, the hunter sits on a chair or stool with the forearm of the firearm sticking out of the blind through a window or similar opening. As mentioned above, hunting is tedious in the sense of nothing happening for long periods, so hunters often choose to support the forearm of the firearm on the window sill of the blind. However, the window sill may not be the correct shooting height for all hunters. Further, this can scratch the forearm of the firearm if the window sill is metal or if there is a zipper around the window of a canvas blind. Still further, the window sill may be slippery if it is made from a metal or hard plastic thereby causing the forearm of the firearm to inadvertently slide laterally instead of resting in place.

Various firearm rest devices have been constructed to aid hunters in resting, aiming, and firing rifles, shotguns, crossbows, and other types of hunting weapons. Some firearm rests attach to the sidewall of a hunting blind to allow the hunter to position the forearm of the gun on the rest with the tip of the barrel extending out of the window. These existing firearm rests have certain disadvantages. Some of these firearm rests attach to the vertical sidewall of the blind near a window. Once attached, these rests are difficult to move or reposition, especially during the critical time when game is in view of the hunter, since that is when it is imperative for the hunter to remain still. Further, the windows in some hunting blinds open inwardly such that the gun rest interferes with opening and closing of the window once the firearm rest is attached to the blind. Similarly, existing firearm rests have a certain height after they are attached to the wall of the blind such that their height cannot be easily adjusted.

There is therefore a need for a firearm rest that overcomes these and other disadvantages in the art.

SUMMARY

One aspect of the present invention generally relates to a firearm rest configured to attach to a mounting surface, such as the generally horizontal window sill of a hunting blind. The firearm rest includes a support member, one or more support posts, and one or more attachment assemblies. The support member provides a generally horizontal surface for a hunter to rest the forearm of a firearm. The support member is combined with the one or more support posts, which extend between the support member and the attachment assembly. In some embodiments the support posts are configured to selectively adjust the height of the support member relative to the attachment assembly from a first position to a second position. A first fastening member such as a screw bolt, latch, or other suitable device may be used to secure the support posts in the second position. Each support post is combined with an attachment assembly configured to secure the firearm rest to the mounting surface. In some embodiments the attachment assembly includes upper and lower support plates. The support plates are spaced apart a predetermined distance and configured to receive the generally horizontal mounting surface between them. In some embodiments the attachment assembly includes a second fastening member configured to engage the mounting surface to help secure the firearm rest to the mounting surface. In some embodiments the fastening member is a mechanical member, such as a screw, bolt, latch, or other suitable device. In other embodiments the fastening member is a frictional gripping member, such as rubber or plastic. The support posts are pivotably combined with the attachment assembly by a mechanical bearing such as a hinge or other suitable means thereby allowing the support member to be movable between an extended shooting position and a retracted non-shooting position while the attachment assembly remains secured to the mounting surface. In the extended position the support member is configured to support a portion of the firearm and in the retracted position the support member is not usable to support a portion of the firearm. The retracted position is sometimes desirable to allow the hunter improved access to the window or window sill of a structure such as a hunting blind. For example, in some hunting blinds the windows open inwardly, and the firearm rest would interfere with the opening and closing of the window in the extended shooting position.

Another aspect of the present invention relates to an adjustable firearm rest for positioning a firearm. The firearm rest includes a horizontal support member attached to at least one vertical support post. The vertical support post has a top end and a bottom end, where the top end is connected to the horizontal support member. The adjustable firearm rest also includes at least one adjustable attachment assembly that is engaged to the bottom end of the at least one vertical support post. The at least one adjustable attachment assembly removably attaches the adjustable firearm rest to a mounting surface. The at least one adjustable attachment assembly includes an attachment section having a first plate or first portion, a second plate or first portion separated from and parallel to the first portion, and a third plate or third portion, that is engaged to the first portion and the second portion such that the first portion and the second portion are held apart at a predetermined distance. The third portion is perpendicular to the first portion and the second portion. The adjustable attachment assembly also has a pivot member having a vertical plate and a horizontal plate that is engaged perpendicularly to the vertical plate, and wherein the vertical plate is hingedly engaged to the attachment section and the horizontal plate is engaged to the at least one vertical support post. The pivot member has a closed position relative to the attachment section where the bottom surface of the horizontal plate is in contact with a top surface of the first portion. Additionally, the inner surface of the vertical plate is in contact with an outer surface of the third portion. While the pivot member is in an open position, the inner surface of the vertical plate and the bottom surface of the horizontal plate are not in contact with any surface of the attachment section. The mounting surface, which is usually a window sill within a hunting blind, fits within the predetermined distance between the first portion and the second portion.

Yet another aspect of the present invention relates to an adjustable firearm rest for positioning a firearm. The firearm rest includes a horizontal support member held up by at least one vertical support post having a top end and a bottom end. The top end is engaged to the horizontal support member. There is an adjustable attachment assembly that is engaged to the bottom end of the e vertical support post via a pivot member. The pivot member has a first position and a second position, and the e adjustable attachment assembly removably attaches the adjustable firearm rest to a mounting surface. The adjustable attachment assembly has a C shaped attachment member having a horizontal first portion, a horizontal second portion that is separated from and parallel to the horizontal first portion, and a vertical third portion that is engaged to the horizontal first portion and the horizontal second portion such that the horizontal first portion and the horizontal second portion are held apart at a predetermined distance. The vertical third portion is perpendicular to the horizontal first portion and the horizontal second portion. The mounting surface fits within the predetermined distance between the horizontal first portion and the horizontal second portion. When the pivot member is in the first position, the vertical support post is held vertically in relation to the mounting surface. The vertical support post is at any other angle when the pivot member is in the second position.

Yet another aspect of the present invention relates to an adjustable firearm rest for positioning a firearm. The firearm rest includes a horizontal support member supported by at least one vertical support post. The vertical support post has a hollow outer support post and an inner support post disposed at least partially within the hollow outer support post. The vertical support post is engaged to the horizontal support member, and the inner support post and the hollow outer support post have a first position and a second position relative to one another. There is least one adjustable attachment assembly that is engaged to the vertical support post, and the at least one adjustable attachment assembly removably attaches the adjustable firearm rest to a mounting surface. The at least one adjustable attachment assembly has a C shaped attachment member with a horizontal first portion, a horizontal second portion that is separated from and parallel to the horizontal first portion, and a vertical third portion that is engaged to the horizontal first portion and the horizontal second portion. The horizontal first portion and the horizontal second portion are held apart at a predetermined distance, and the vertical third portion is perpendicular to the horizontal first portion and the horizontal second portion. There is also a pivot member with a vertical plate and a horizontal plate that is engaged perpendicularly to the vertical plate. The vertical plate is hingedly engaged to the C shaped attachment member and the horizontal plate is engaged to the at least one vertical support post. The pivot member has a closed position relative to the C shaped attachment member where a bottom surface of the horizontal plate is in contact with a top surface of the horizontal first portion and an inner surface of the vertical plate is in contact with an outer surface of the vertical third portion. The pivot member has an open position wherein the inner surface of the vertical plate and the bottom surface of the horizontal plate are not in contact with any surface of the C shaped attachment member.

Another aspect of the invention relates to a method of using the firearm rest described above. The method includes positioning the mounting surface between the upper and lower support plates of the attachment assembly, then tightening the first fastener to help secure the firearm rest to the mounting surface. In some cases, the mounting surface is the generally horizontal window sill of a hunting blind. Moving the support member to the extended position when the hunter desires to use the gun rest to support the forearm of the firearm, and moving the support member to the retracted position when the hunter desires to have improved access to the blind's window or window sill. Some embodiments further include adjusting the height of the support posts from a first position to a second position then tightening the second fastening member to help secure the support posts in the second position.

DETAILED DESCRIPTION

Figure 1:
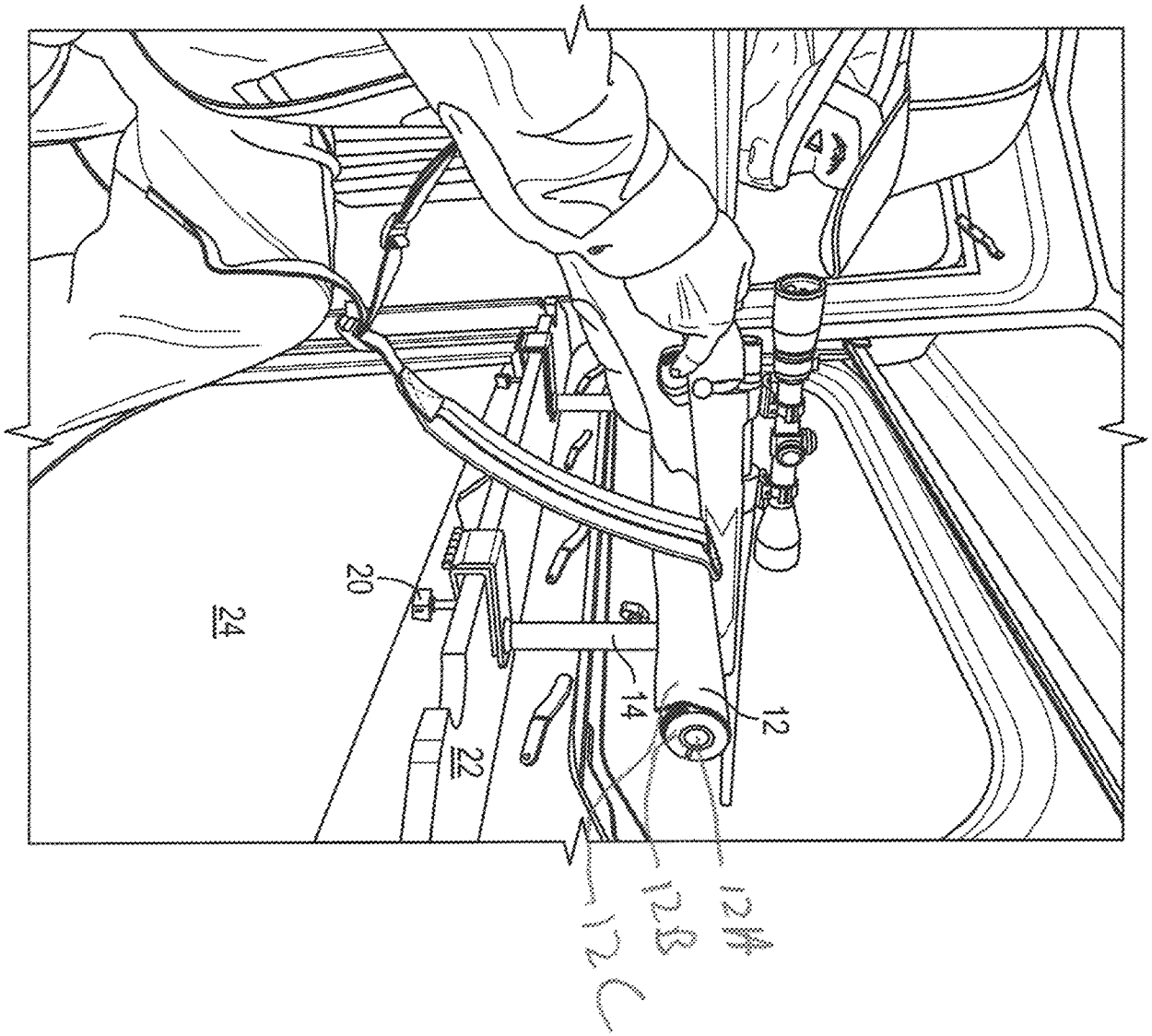
FIG. 1 is a perspective view of the firearm rest in an extended shooting position, wherein the firearm rest is secured to the window sill of a game blind.

As shown in FIG. 1, the invention generally relates to a firearm rest 10 configured to attach to a mounting surface 22, such as the generally horizontal window sill of a hunting blind 24. The firearm rest 10 generally includes a support member 12, support posts 14, 15, and an attachment assembly 18. The invention is described herein with reference to firearms, however, it may also be used with crossbows and other weapons.

Figure 2:
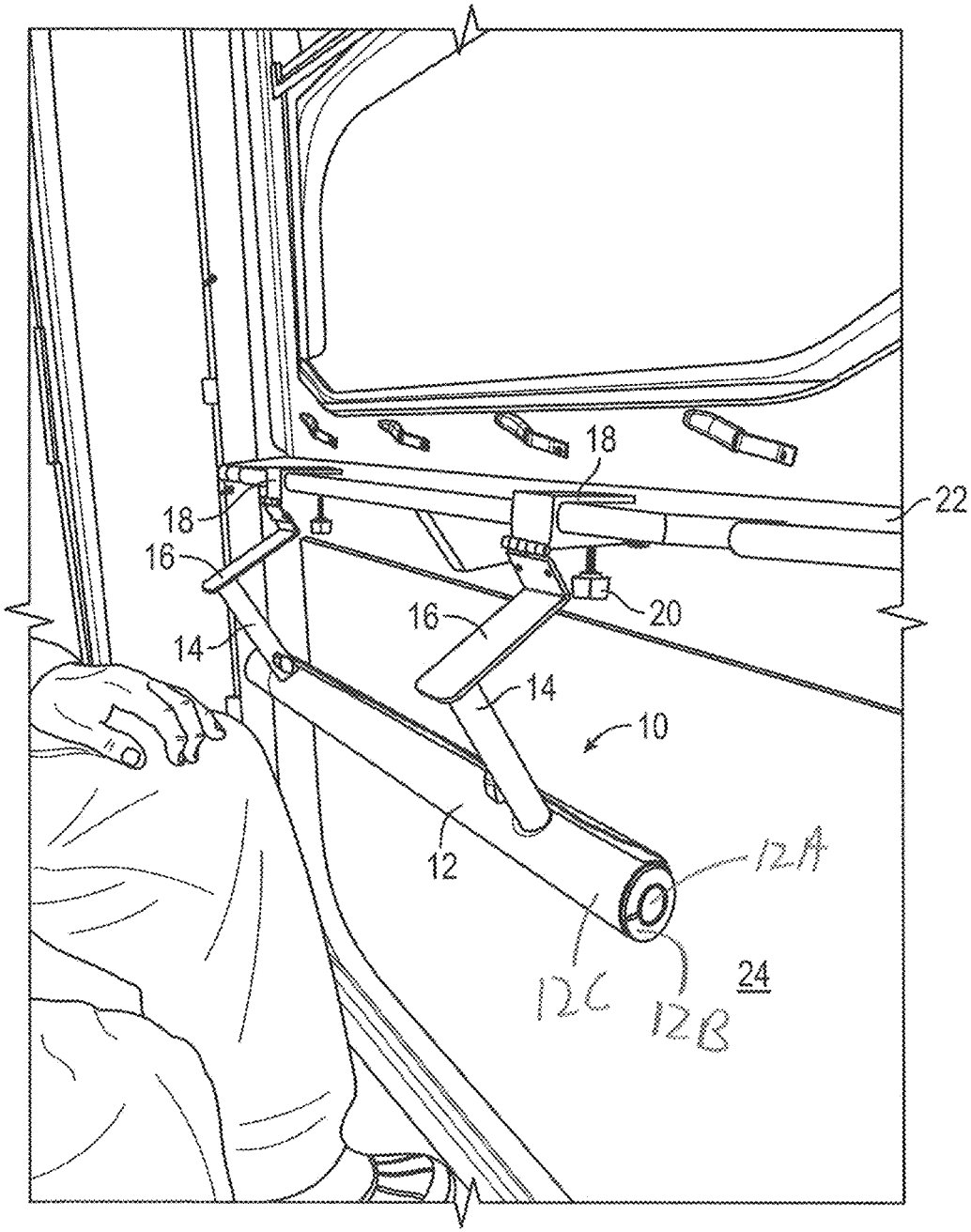
FIG. 2 is a perspective view of the firearm rest in a retracted position, wherein the firearm rest is secured to the window sill of a game blind.

FIGS. 1, 2, 4 and 5 generally show the support member 12. The support member 12 may be a generally elongated member having a generally horizontal surface for a hunter to rest the forearm of a firearm, as shown in FIG. 1. In some embodiments, the support member 12 has a length similar to a length of the window of the hunting blind 24. As shown in FIGS. 1 and 2, the support member 12 may have a generally rigid inner frame structure 12A, such as metal, wood, or plastic, to provide the support member 12 strength to support the firearm. The support member 12 may have a soft and/or compressible middle layer 12B made of foam, plastic, or other suitable materials to help support the forearm of the firearm. The weight of the firearm may cause the forearm to compress slightly downward into the compressible middle layer 12B which helps keep the forearm of the firearm from accidently moving laterally. The support member 12 may have a soft outer surface 12C such as fabric or leather to help prevent the forearm of the firearm from getting scratched or damaged. In some embodiments the outer surface 12C of the support member 12 includes a friction material or mildly sticky material to help prevent the forearm of the firearm from accidently moving laterally along the length of the support member 12. The friction material allows the hunter to move the forearm of the firearm along the support member 12 if desired, but the forearm of the firearm will not slide along the support member 12 without the hunter's purposeful action.

Figure 3:
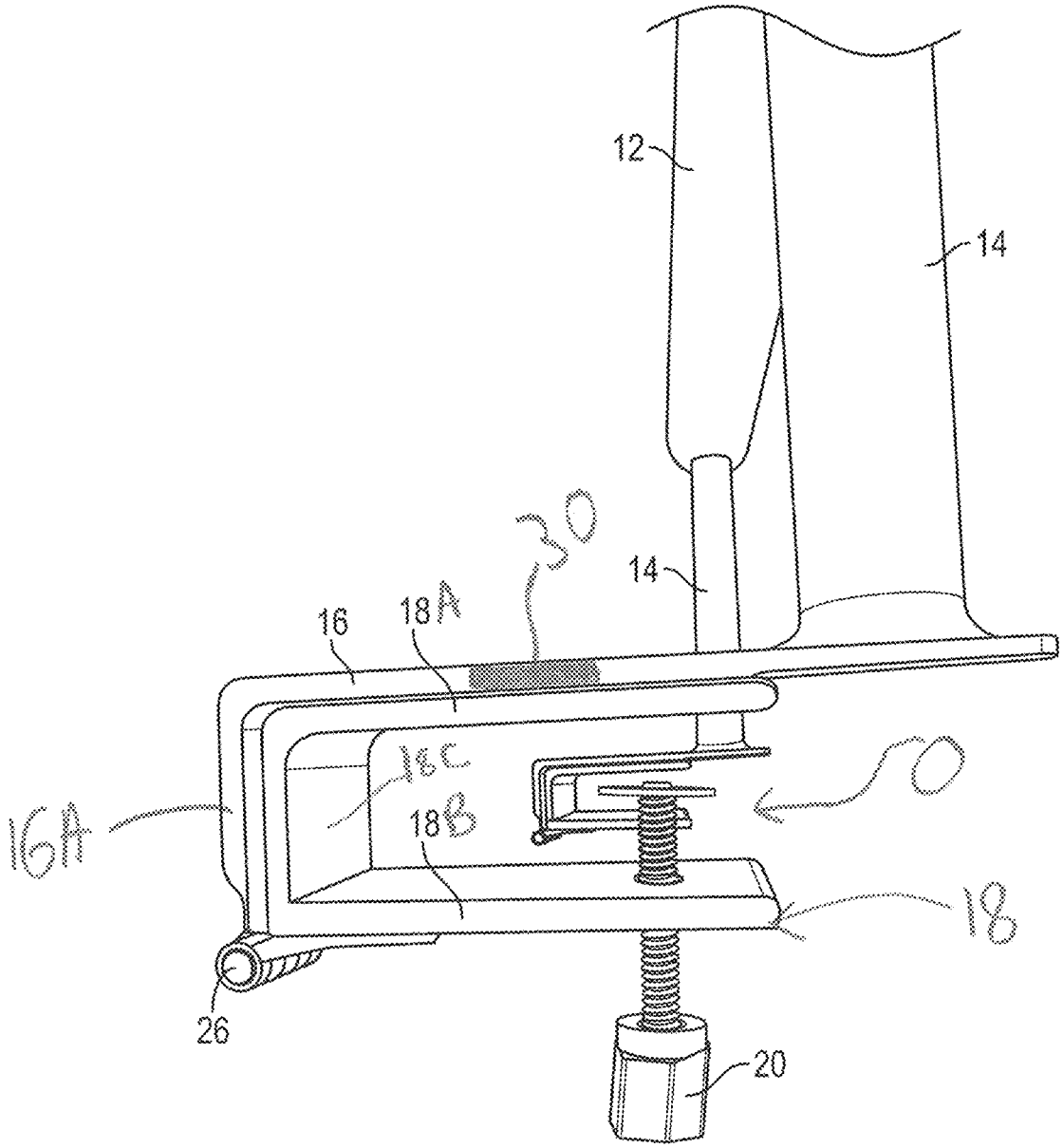
FIG. 3 is a side view of the firearm rest.
Figure 4:
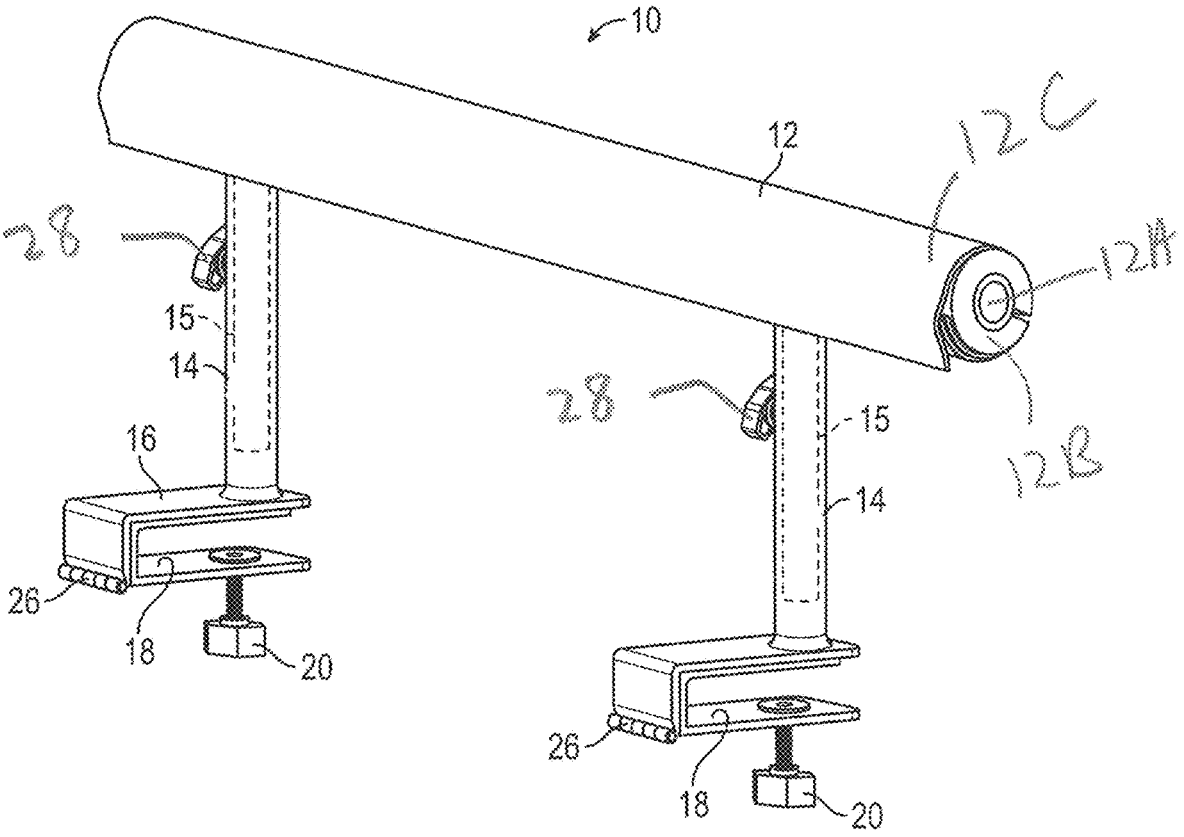
FIG. 4 is a perspective view of the firearm rest wherein the firearm rest is in a first (lowered) position.
Figure 5:
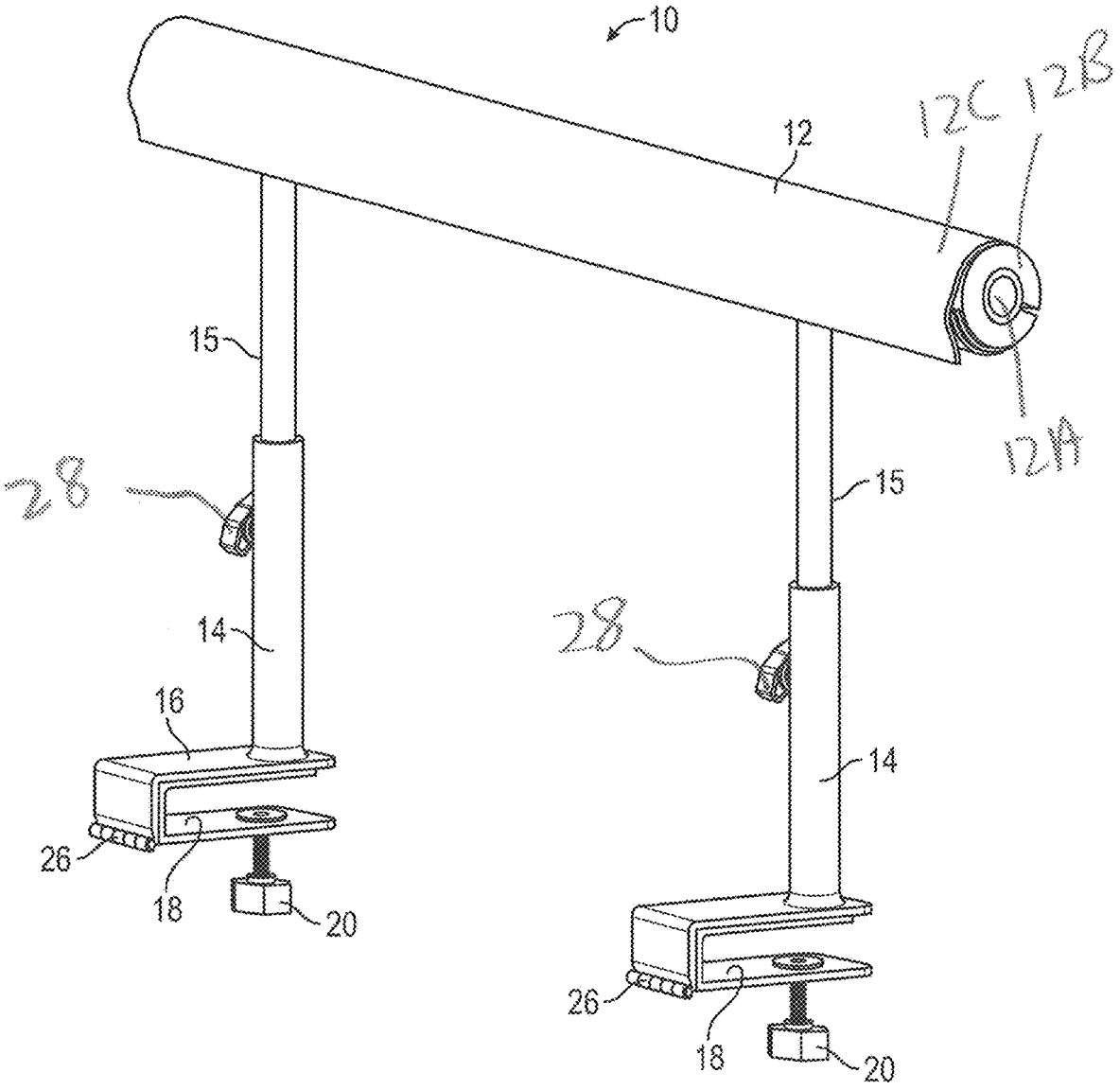
FIG. 5 is a perspective view of the firearm rest wherein the firearm rest is in a second (raised) position.

As shown in FIGS. 1-5, the support member 12 is combined with the one or more support posts 14, 15, which extended between the support member 12 and the attachment assembly 18. In use the support posts 14, 15 help hold the support member 12 above the mounting surface 22 to a predetermined height. In some embodiments the support posts 14, 15 are configured to selectively adjust the height of the support member 12 relative to the attachment assembly 18. In the embodiment shown, each end of the support member 12 is supported by two support posts 14, 15. A first support post 15 is combined with the support member 12 and a second support post 14 is combined with the attachment assembly 18. In the embodiment shown, the support posts 14 are indirectly combined with the attachment assembly 18 through the intermediate pivot member 16, which is described below. The first support post 15 is positioned within and movable relative to the second support post 14. It should be noted that either support post 14, 15 may be positioned within the other support post 14, 15 and either support post 14, 15 may be combined with the support member 12 or the attachment assembly 18. The relative position of the posts 14, 15 can be adjusted between a first position and a second position so the support member 12 is at the desired height. Then, a fastening member 28 such as a screw, bolt, latch, or other suitable device is used to secure the first support post 15 relative to the second support post 14 in the second position. FIG. 4 shows the support member 12 at a first height wherein the first support post 15 is lowered within the second support post 14 to the first position and FIG. 5 shows the support member 12 at a second height wherein the first support post 15 is raised within the second support post 14 to the second position. Adjusting and setting the height of the support member 12 relative to the attachment assembly 18 is independent from the pivotal movement of the support member 12 between the extended position and the retracted position (described herein). Further, adjusting and setting the height of the support member 12 relative to the attachment assembly 18 is independent from attaching/removing the attachment assembly 18 to/from the mounting surface 22. In other words, once the height is set (e.g. the second position), the firearm rest 10 may be pivoted about the pivot axis and/or attached/detached to/from the mounting surface 22 without affecting the distance between the support member 12 and the attachment assembly 18. Maintaining the height of the support member 12 during pivotal movement or attaching/detaching the firearm rest 10 eliminates the need for the hunter to have to adjust the height every time the firearm rest 10 is moved or repositioned.

As shown in FIGS. 1-5, each support post 14 is combined with an attachment assembly 18. Each attachment assembly 18 is configured to secure the firearm rest 10 to the mounting surface 22. As shown in FIG. 3, in some embodiments the attachment assembly 18 includes a first support plate 18A and a second support plate 18B. The support plates 18A, 18B are spaced apart a predetermined distance and configured to receive the generally horizontal mounting surface 22 between them. The attachment assembly may generally be a "C" shape having an opening O in an open side and a closed side 18C. The opening O in the open side is configured to receive the mounting surface 22. In some embodiments the attachment assembly 18 includes a fastening member 20, such as a screw, bolt, latch, or other suitable device configured to engage the mounting surface 22 to help secure the firearm rest to the mounting surface 22. As shown, the fastening member 20 may by a thumb screw having an end configured to engaged and tighten against the mounting surface 22.

The support posts 14, 15 and support member 15 are pivotably combined with the attachment assembly 18 by a mechanical bearing 26 such as a hinge or other suitable means. This allows the support member 12 to be rotate about a pivot axis between an extended shooting position (FIG. 1) and a retracted non-shooting position (FIG. 2) while the attachment assembly 18 remains secured to the mounting surface 22. In the extended position the support member 12 is configured to support a portion of the firearm and in the retracted position the support member 12 is not usable to support a portion of the firearm. The retracted position is sometimes desirable to allow the hunter better access to the window or window sill 22. For example, in some hunting blinds 24 the windows open inwardly, and the firearm rest 10 would prevent opening/closing of the window in the engaged shooting position.

In one embodiment shown best in FIG. 3, one of the support post 14 is combined with an intermediate pivot member 16. The intermediate pivot member 16 may be an angled member that is adjacent to and generally contours to (has the same shape as) the first support plate 18A and the closed side 18C of the attachment assembly 18. In the embodiment shown, the intermediate pivot member 16 has a generally flat top surface that is generally adjacent to and mates against the first (upper) support plate 18A and an angled portion 16A that generally is adjacent to and mates against the closed portion 18C of the attachment assembly 18. This allows the intermediate pivot member 16 to lay flat against the upper support plate 18A of the attachment assembly 18 when the firearm rest 10 is in the engaged/usable position, as shown in FIG. 3. As shown, this also allows the mechanical bearing 26 to be positioned near the lower rear surface of the angled portion 16A of the intermediate pivot member 16.

In some embodiments either of the intermediate pivot member 16 or the upper support plate 18A may include a fastener 30, such as a magnet or hook and loop material. The fastener 30 helps bias the firearm rest 10 in the extended position until the hunter applies force to overcome the biasing force holding the components 16, 18A together to purposefully move the firearm rest 10 to the retracted position. In other words, the fastener 30 helps prevent inadvertent movement of the firearm rest 10 from the extended position to the retracted position. In the embodiment shown in FIG. 3, the fastener 30 is a magnet placed within or secured to the surface of either the pivot member 16 or the upper support plate 18A. The other component 16, 18A is made of a magnetic or ferrous material so the magnet and the magnetic material create a biasing force when the two surfaces are near each other.

In use, the firearm rest 10 may be secured to the mounting surface 22 by positioning the mounting surface 22 between the upper 18A and lower 18B support plates of the attachment assembly 18, then tightening the first fastening member 20 to help secure the firearm rest 10 to the mounting surface 22. In some cases, the mounting surface 22 is the generally horizontal window sill of a hunting blind 24. Moving the support member 12 to the extended position when the hunter desires to use the gun rest to support the forearm of the firearm, and moving the support member 12 to the retracted position when the hunter desires to have improved access to the blind's window or window sill. Some embodiments further include adjusting the height of the support posts 14, 15 from a first position (FIG. 4) to a second position (FIG. 5) then tightening the second fastening member 28 to help secure the support posts 14, 15 in the second position.

Once the height of the support member 12 is set, the support member 12 remains at that height (e.g., the second position) even if the user moves the support member 12 between the extended position and the retracted position. In other words, pivoting the support member 12 about the pivot axis relative to the attachment assembly 18 does not affect the height of the support member 12 relative to the attachment assembly 18. Further, the height of the support member 12 relative to the attachment assembly 18 is not affected by attaching/removing the attachment assembly 18 to/from the mounting surface 22. Maintaining the height of the support member 12 during pivotal movement or attaching/detaching the firearm rest 10 eliminates the need for the hunter to have to adjust the height every time the firearm rest 10 is moved or repositioned.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included with in the scope of the following claims.

What is claimed is as follows:

1. An adjustable firearm rest configured for attaching to a mounting surface, the adjustable firearm rest comprising:
- a support member;
- at least one support post having a top portion and a bottom portion, wherein the top portion is engaged to the support member;
- at least one adjustable attachment assembly that is engaged to the bottom portion of the at least one support post;
- wherein the at least one adjustable attachment assembly comprises:
  - an attachment section having a first portion and a second portion connected by a closed side;
  - a pivot member having a first pivot portion and a second pivot portion that is engaged to the first pivot portion, and wherein the first pivot portion is hingedly engaged to the attachment section and the second pivot portion is engaged to the at least one support post;
  - wherein the pivot member is configured to move between a closed position and an open position.

2. The adjustable firearm rest of claim 1 wherein the mounting surface is a generally horizontal portion a hunting blind and wherein when the pivot member is in the closed position a bottom surface of the second pivot portion is in contact with a top surface of the first portion and an inner surface of the first pivot portion is in contact with an outer surface of the third portion, and wherein when the pivot member is in the open position the inner surface of the first pivot portion and the bottom surface of the second pivot portion are not in contact with any surface of the attachment section.

3. The adjustable firearm rest of claim 1, wherein at least one of the first portion and the second pivot portion comprise a fastener configured to selectively secure the first portion to the second pivot portion.

4. The adjustable firearm rest of claim 1, wherein the support member comprises a rigid inner member, a compressible middle layer that surrounds the rigid inner member, and a soft outer surface layer that surrounds the compressible middle layer.

5. The adjustable firearm rest of claim 1, wherein the attachment section further comprises a fastening member configured to selectively engage the mounting surface.

6. The adjustable firearm rest of claim 1, wherein the attachment section further comprises a thumb screw having an end that is in engagement with the mounting surface.

7. An adjustable firearm rest configured for attaching to a mounting surface, the adjustable firearm rest comprising:
- a support member;
- at least one support post having a top portion and a bottom portion, wherein the top portion is engaged to the support member;
- at least one adjustable attachment assembly that is engaged to the bottom portion of the at least one support post;
- wherein the at least one adjustable attachment assembly comprises:
  - an attachment section having a first portion, a second portion, and a third portion that is engaged to the first portion and the second portion such that the first portion and the second portion are held apart at a predetermined distance;
  - a pivot member having a first pivot portion and a second pivot portion that is engaged to the first pivot portion, and wherein the first pivot portion is hingedly engaged to the attachment section and the second pivot portion is engaged to the at least one support post;
  - wherein the pivot member is configured to move between a closed position and an open position; and
- wherein the predetermined distance between the first portion and the second portion is configured to fit the mounting surface.

8. The adjustable firearm rest of claim 7, wherein the at least one support post comprises an inner support post and a hollow outer support post, wherein the inner support post is at least partially slidably disposed within the hollow outer support post, and wherein either 1) the inner support post is connected to the pivot member and the hollow outer support post is connected to the support member, or 2) the inner support post is connected to the support member and the hollow outer support post is connected to the pivot member.

9. The adjustable firearm rest of claim 8, wherein the at least one support post has a first position wherein the inner support post and the hollow outer support post are at a first relative position relative to one another and a second position wherein the inner support post and the hollow outer support post are at a second relative position relative to one another, and wherein the at least one support post further comprises a fastening member that secures the inner support post and the hollow outer support post when the at least one support post is in the first position or the second position.

10. The adjustable firearm rest of claim 7 wherein the mounting surface is a generally horizontal window sill of a hunting blind and wherein when the pivot member is in the closed position a bottom surface of the second pivot portion is in contact with a top surface of the first portion and an inner surface of the first pivot portion is in contact with an outer surface of the third portion, and wherein when the pivot member is in the open position the inner surface of the first pivot portion and the bottom surface of the second pivot portion are not in contact with any surface of the attachment section.

11. The adjustable firearm rest of claim 7, wherein at least one of the first portion and the second pivot portion comprise a fastener configured to selectively secure the first portion to the second pivot portion.

12. The adjustable firearm rest of claim 7, wherein the support member comprises a rigid inner member, a compressible middle layer that surrounds the rigid inner member, and a soft outer surface layer that surrounds the compressible middle layer.

13. The adjustable firearm rest of claim 7, wherein the attachment section further comprises a fastening member configured to selectively engage the mounting surface.

14. The adjustable firearm rest of claim 7, wherein the attachment section further comprises a thumb screw having an end that is configured to engage with the mounting surface.

15. An adjustable firearm rest configured for attaching to a mounting surface, the adjustable firearm rest comprising:

a support member having a generally horizontal configuration;

at least one support post having a top portion and a bottom portion, wherein the top portion is engaged to the support member, wherein the at least one support post has a generally vertical configuration;

at least one adjustable attachment assembly that is engaged to the bottom portion of the at least one support post via a pivot member having a first position and a second position;

wherein the at least one adjustable attachment assembly comprises:

an attachment member having a horizontal first portion, a horizontal second portion that is separated from and parallel to the horizontal first portion, and a vertical third portion that is engaged to the horizontal first portion and the horizontal second portion such that the horizontal first portion and the horizontal second portion are held apart at a predetermined distance, wherein the vertical third portion is perpendicular to the horizontal first portion and the horizontal second portion; and wherein the mounting surface fits within the predetermined distance between the horizontal first portion and the horizontal second portion and wherein when the pivot member is in the first position, the at least one support post is held vertically in relation to the mounting surface, and when the pivot member is in the second position, the at least one support is not held vertically in relation to the mounting surface.

16. The adjustable firearm rest of claim 15, wherein the pivot member comprises a vertical plate and a horizontal plate that is engaged perpendicularly to the vertical plate, and wherein the vertical plate is hingedly engaged to the attachment member and the horizontal plate is engaged to the at least one support post, and wherein the attachment member is generally C-shaped.

17. The adjustable firearm rest of claim 16, wherein the at least one support post comprises an inner support post, and a hollow outer support post, wherein the inner support post is at least partially slidably disposed within the hollow outer support post, and wherein either 1) the inner support post is connected to the pivot member and the hollow outer support post is connected to the support member, or 2) the inner support post is connected to the support member and the hollow outer support post is connected to the pivot member.

18. The adjustable firearm rest of claim 17, wherein the at least one support post has a first position wherein the inner support post and the hollow outer support post are at a first relative position relative to one another and a second position wherein the inner support post and the hollow outer support post are at a second relative position relative to one another, and wherein the at least one support post further comprises a fastening member that secures the inner support post and the hollow outer support post when the at least one support post is in the first position or the second position.

19. The adjustable firearm rest of claim 15, wherein the support member comprises a rigid inner member, a compressible middle layer that surrounds the rigid inner member, and a soft outer surface layer that surrounds the compressible middle layer.

20. The adjustable firearm rest of claim 19, wherein the horizontal first portion of the attachment member, the horizontal plate of the pivot member, or both the horizontal plate of the pivot member and the horizontal first portion the attachment member further comprise a fastener chosen from a hook and loop fastener or a magnet.

* * * * *